United States Patent [19]

Morgan

[11] 4,192,105

[45] Mar. 11, 1980

[54] INFLATABLE BUILDING AND ANCHOR MEANS FOR PIPELINE CONSTRUCTION

[75] Inventor: Burton D. Morgan, Hudson, Ohio

[73] Assignee: Concept Development Institute, Inc., Hudson, Ohio

[21] Appl. No.: 903,459

[22] Filed: May 8, 1978

[51] Int. Cl.[2] ..... E04B 1/34

[52] U.S. Cl. ..... 52/2; 52/66; 52/DIG. 12

[58] Field of Search ..... 52/2, DIG. 12, 63, 66

[56] References Cited

U.S. PATENT DOCUMENTS

| | | | |
|---|---|---|---|
| 2,411,316 | 11/1946 | Capita | 52/2 |
| 2,832,362 | 4/1958 | Critoph | 52/63 |
| 3,412,509 | 11/1968 | Popil | 52/2 |
| 3,619,957 | 11/1971 | Adam | 52/2 |
| 3,777,425 | 12/1973 | Bourgeois | 52/2 |
| 3,815,299 | 6/1974 | Sörensen | 52/66 |
| 4,038,788 | 4/1977 | Claessens | 52/2 |

FOREIGN PATENT DOCUMENTS

| | | | |
|---|---|---|---|
| 1684162 | 10/1969 | Fed. Rep. of Germany | 52/DIG. 12 |
| 444869 | 2/1972 | U.S.S.R. | 52/DIG. 12 |
| 545731 | 3/1977 | U.S.S.R. | 52/2 |

OTHER PUBLICATIONS

*Construction Methods & Equipment* Mar. 1977 -Methods Memo.

*Primary Examiner*—James A. Leppink
*Assistant Examiner*—Henry E. Raduazo
*Attorney, Agent, or Firm*—Oldham, Oldham, Hudak & Weber Co.

[57] ABSTRACT

A portable structure for use in building pipelines and the like including an inflatable flexible elongated structure having sides and open ends, support track means operably engaged with each side of said structure and extending the structure length, and a plurality of anchor means or assemblies thereof, each including a device to engage the track means, a part of the anchor means engaging the ground to hold the structure against vertical upward movement, but permitting relative movement between the track means and the anchor means so that the structure can be operatively positioned by the anchor means but be movable in relation thereto.

8 Claims, 5 Drawing Figures

INFLATABLE BUILDING AND ANCHOR MEANS FOR PIPELINE CONSTRUCTION

BACKGROUND OF INVENTION

It is well known that, at the present time, many construction projects are being built under extremely adverse temperature, weather and terrain conditions. One primary example of a lengthy narrow structure built in a cold climate is the Alaskan Pipeway. Other similar structures are contemplated or are in the process of being produced.

Accordingly, it is very desirable to have some type of inflatable portable shelter for use by personnel working on these elongate structures that, as they are built, are continuously advancing or being moved along the support surface. Various types of inflatable shelters have been provided heretofore for telephone line repairmen, ice fishermen, and the like, but insofar as I am aware, there is not a feasible shelter unit provided for protecting the workers constructing elongate, continuous structures, such as pipelines, from the elements and adverse weather conditions. Accordingly, the need for such a structure is great.

It is a general object of the present invention to provide an improved portable shelter and attaching means therefor, particularly an inflatable flexible structure adapted to be moved along on a center axis of the structure to accompany the growth and building of a progressive elongate structure, such as a pipeline.

Another object of the invention is to provide a plurality of anchor means adapted to engage a support track operatively engaged with the sides of an inflatable structure to permit the structure to be moved along in relation to the anchor means, but yet to be held down adjacent the earth by the anchor means that releasably engage the track member and permit relative movement of the track and anchor means.

Another object of the invention is to provide a relatively inexpensive but durable inflatable structure of arcuate shape in vertical section that has tracks extending along the sides thereof and individual anchor members engaging longitudinally spaced portions of the tracks to hold the inflatable structure in position, and shelter the interior area of the structure.

Another object of the invention is to provide an elongate structure having open ends and which can be progressively engaged with a plurality of anchor devices formed in rows parallel with the longitudinal axis of such inflatable structure, and which anchor devices have roller members to engage means on the structure to permit relative movement between the structure and the devices; the anchor being movable along with the construction project.

The foregoing and other objects and advantages of the invention will be made more apparent as the specification proceeds.

In the accompanying drawings.

When referring to corresponding members shown in the drawings and referred to in the specification, corresponding numerals are used to facilitate comparison therebetween.

SUBJECT MATTER OF INVENTION

Figure 1:
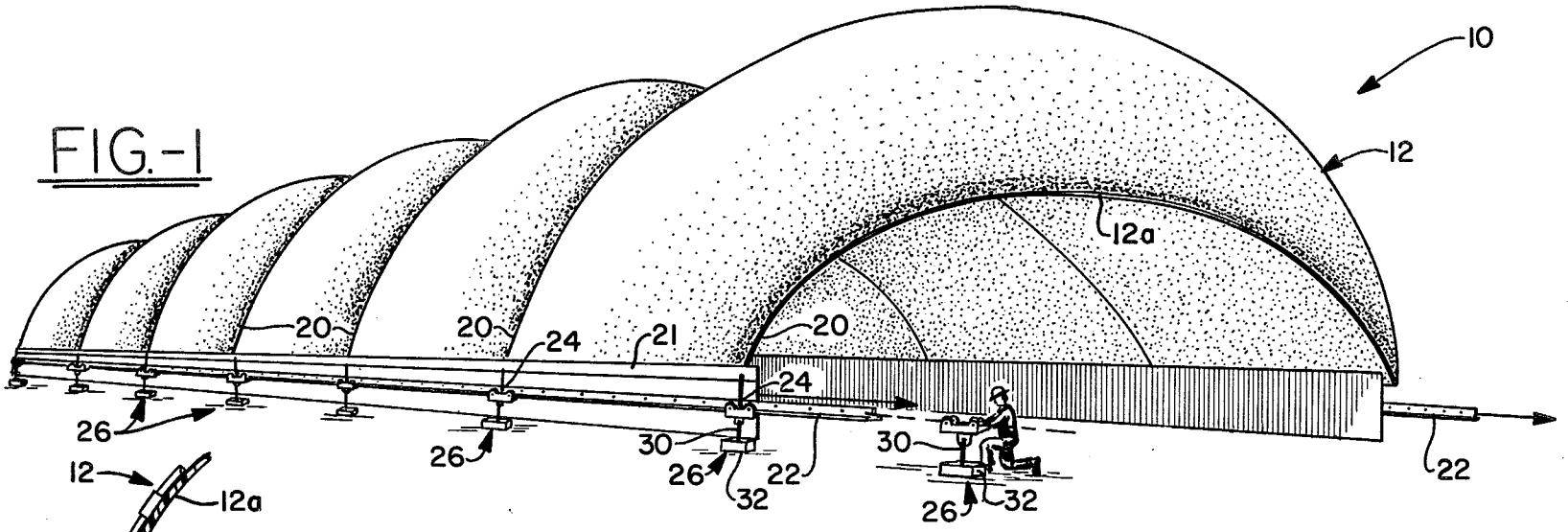
FIG. 1 is a perspective view of an inflatable structure and associated means embodying the principles of the invention.
Figure 2:
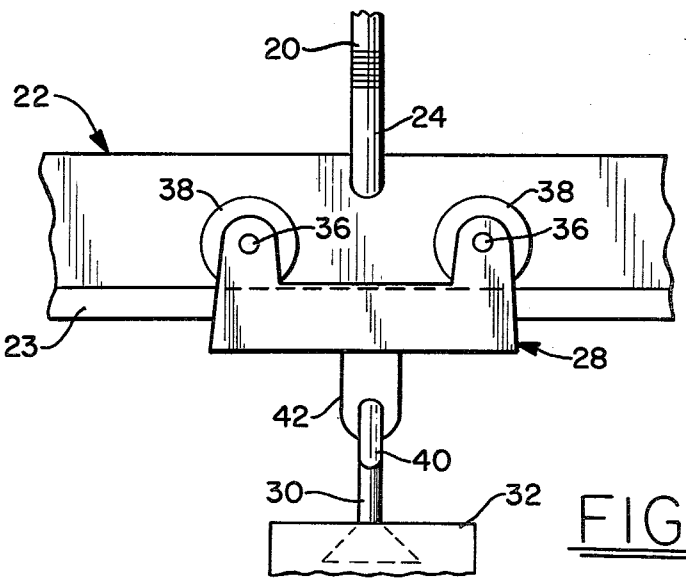
FIG. 2 is an enlarged fragmentary side elevation of a support track shown in operative engagement with an anchor means.
Figure 3:
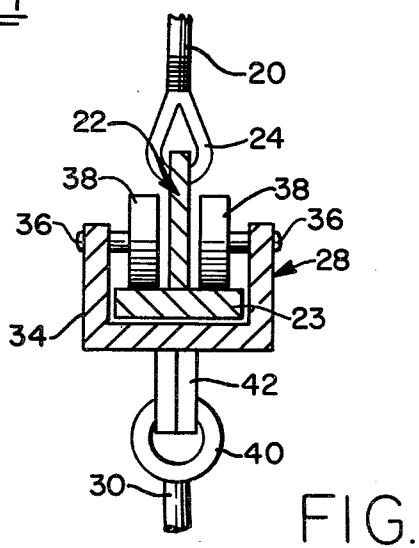
FIG. 3 is a fragmentary vertical section of the support track and associated means.
Figure 4:
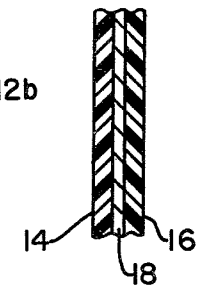
FIG. 4 is a fragmentary enlarged section through the flexible sheet structure used in forming the shelter unit of FIG. 1.
Figure 5:
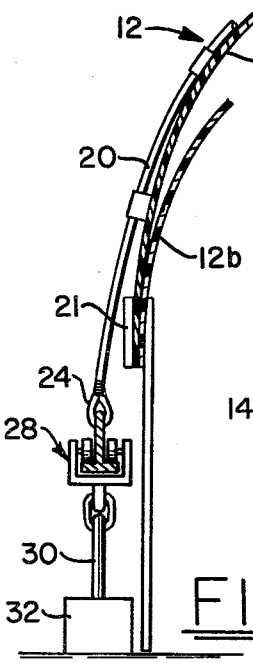
FIG. 5 is a fragmentary vertical section of a side portion of the apparatus.

A portable inflatable shelter for movement along a continuous work area and attaching means for such shelter, the improvement comprising an inflatable flexible structure having an arcuate shape in vertical section, and having open ends and a center axis; reenforcing members operatively engaging said flexible structure and effectively extending about the length thereof along both sides thereof. A support track means is provided on each side of the structure and extends the length thereof, the track structure being engaged with and supported by said reenforcing members, and a plurality of anchor means resting upon the ground at longitudinally spaced areas and defining lines parallel to the center axis of said structure adjacent each side thereof, each anchor means including a device for engaging the support track at a local area thereof to hold the flexible structure against vertical upward movement so that the structure can be operatively positioned by the anchor means but yet be moved in a generally axial direction in relation to the anchor means to shelter the work area, which structure can be progressively moved along a desired continuous pipeline or the like.

Reference now is particularly made to the details of the structure shown in the accompanying drawings, and a portable shelter is indicated as a whole by the numeral 10. This shelter 10 includes an inflatable flexible structure 12 that usually is of arcuate shape in vertical section and which normally has open ends. The structure 12 has a longitudinally extending axis and the shelter 10 is adapted to be progressively moved in the direction of the longitudinal axis of the shelter 12 for progressively covering or enclosing a continuous elongate work area, such as one required in building pipelines or the like. This shelter 10 is adapted to be moved progressively along with the building of the pipeline for enclosing a work area and facilitating construction of the elongate pipe unit or other work in process.

This inflatable flexible structure 12 may be made from any suitable material or laminate and, thus, the inflatable bag or enclosure is shown made from a laminate material, including layers 14 and 16 of vinyl, suitably secured together by a flexible center metal sheet 18. Any conventional adhesive or other means can be used for forming this flexible laminate that is durable, tough, and weather resistant to stand exposure to severe weather conditions.

It is desirable to reinforce the structure 12 at least along the top or at the lower side margins thereof and, in this instance, a plurality of reenforcing members such as the cables or straps 20 are attached or bonded to the structure 12 by loops or straps or other means on the top or outer surface thereof so as to engage the structure 12 at a plurality of longitudinally spaced areas thereof, and with the cables or straps 20 extending completely from side to side of the structure.

The drawing shows that a support track 22 is provided at each side of the structure 12 and such track extends at least substantially the length of the structure. The track may protrude forwardly beyond the structure and also protrude rearwardly slightly from the rear end of the structure, when considering the structure to be movable along its longitudinal axis. Means, such as anchor loops 24, are provided at the ends of the cable 24, and they engage the track to attach it to the inflatable structure for movement therewith. The track 22 preferably is of inverted T-shape in vertical section, and the loops 24 engage the center leg portion of this track. The track preferably is made from metal and is of conventional construction suitable for carrying the weight and forces applied to the structure 12 to aid in maintaining it in a given position and controlling the movement and normal inflated position thereof.

So as to retain this inflatable structure 12 in position, and to aid in providing controlled movement of the structure along its longitudinal axis, in alignment with a pipeline for example, a plurality of anchor means 26 are provided. Each of these anchor means includes a roller or slide device 28, a support arm 30, and an anchor block or member 32. The anchor blocks 32 are resting on the ground or may be embedded therein, as desired, and these roller devices 28 preferably are made of a substantially U-shaped frame 34 that has a plurality of stub shafts 36 secured thereto and journalling rolls 38 thereon. These rolls 38 are of conventional design and are carried by the stub shafts 36 to engage the exposed surface of the base 23 of the T-shaped track 22. Hence, a low friction, rolling engagement support action is provided for the structure 12 by the plurality of anchor devices 26 of the invention engaging the elongate track.

In some instances, it may be desirable to provide a substantially rigid support arm assembly 30 connecting the anchor block 32 and the roller device 28, or the roller device may be formed on the support arm, or the arm 30 may be of any conventional construction to be adjustable in length. Usually the support arm assembly 30 has an eye or hook portion 40 at its upper end engaging with a dependent flange 42 of the roller device 28, and the arm preferably is pivotal in relation to the anchor block or be detachable therefrom as desired.

It will be noted that a plurality of these anchor devices or means 26 are provided along each side of the inflated structure 12 and that these anchor devices are in alignment with each other. Normally the rows of anchor devices are parallel with each other and with the longitudinal axis of the structure 12 as well as that of the desired work area.

The inflatable structure 12 can have any suitable lighter-than-air gas in the chamber formed between the chamber walls **12*a* and 12*b* to maintain the gas at any desired pressure. A reenforcing member 12*a* may be provided at the end of the structure 12 and longitudinally extending reenforcements 21** usually engage the structure at or adjacent its side edges.

It will be seen that the work area must progressively move along as the pipeline is constructed so that the entire structure 12 must be moved longitudinally by increments by an external member, such as a tractor, truck or the like secured to end portions of the structure by cables or the like to move the inflatable structure axially to continue to enclose such work area. The anchor devices preferably are provided in sufficient number that there are always anchor devices provided at the front or upstream end of the structure 12, ready to have the track roller devices 28 thereof engage with the leading ends of the support tracks 22. Then such roller devices will progressively be moved with relation to the structure 12 as it is pulled along its longitudinal axis so that, ultimately, a roller device 28 would be released from the trailing end of the support track 22. That same anchor device next would be moved from the downstream end of the structure 12 up to the leading or upstream end of or in advance of the track for a repeat engagement with the track 22. Usually a manual engagement action of the roller devices with the leading end of the track 22 can be readily obtained.

Any suitable end flaps or closure means can be secured to the structure 12 at its open ends.

From the foregoing, it will be seen that an inflatable structure has been provided with special support track means thereon, and that novel anchor means has been provided for engaging with the support track means to form a unit that will enclose an elongate, progressive, changing work area. Thus, the objects of the invention are achieved by the provision of this mechanically sound, easily moved structure that can be progressively moved by steps along a continuous relatively narrow work area.

While one complete embodiment of the invention has been disclosed herein, it will be appreciated that modification of this particular embodiment of the invention may be resorted to without departing from the scope of the invention.

What is claimed is:

1. A portable inflatable shelter and attaching means therefor comprising an inflatable flexible structure of elongate shape and having open ends, and being of arcuate shape in vertical section, track means at each side of said structure and extending substantially the length thereof and being operatively secured to said structure, and a plurality of movable anchor means each including pivotal devices to engage said track means at spaced portions thereof and hold said structure against vertical upward movement but permitting relative movement between said devices and said track whereby said structure can be operatively positioned by said anchor means but be movable in relation thereto.

2. A portable inflatable shelter as in claim 1 where reenforcing members operatively engage the structure at both sides thereof, and said reenforcing members being flexible and extending downwardly of the structure at its sides to engage and position said track means.

3. A portable inflatable shelter as in claim 1 where reenforcing members operatively engage said structure and extend the width of the structure from one side thereof to the other side thereof at longitudinally spaced portions thereof to engage said support track means, and said support track means are of inverted T-shape in section to form flat surfaces for operatively engaging said devices.

4. A portable inflatable structure as in claim 1 where said anchor means are on the ground and a series of anchor means are provided on each side of said structure aligned parallel to the center axis of said structure, and said track progressively engages ones of said anchor means ahead of said structure and releases ones of said anchor means to the rear of said structure as the structure is moved to a new work area.

5. A portable inflatable shelter for movement along a continuous work area on the ground surface, as for use in building a pipeline or the like, and attaching means therefor and comprising an inflatable flexible structure having an arcuate shape in vertical section and having a top, sides and open ends, and a center axis, reenforcing members operatively engaging said structure and extending the width of the structure from one side thereof across the top to the other side thereof, separate reenforcing members engaging spaced portions of said structure, a support track at each side of said structure and extending the length thereof, said reenforcing members engaging said support track, and a plurality of anchor means movably supported on the ground and each including roller devices to engage said track at spaced portions thereof and hold said flexible structure against vertical upward movement, whereby said structure can be operatively positioned by said anchor means and be moved in a generally axial direction by being moved in relation to said anchor means.

6. A shelter as in claim 5 where said anchor means includes a member resting on the ground, a vertically extending support arm secured to said member and having an upper end operatively engaging said roller devices which are adjustable in relation to said support arm and are maintained in operative position by said support track.

7. A shelter as in claim 5 where said roller devices are operable to engage the leading end of said support track and be released by the trailing end of said support track, and closure means are carried by said structure at said initially open ends.

8. A shelter as in claim 6 where said roller devices are operable to engage the leading end of said support track and be released by the trailing end of said support track, and a series of anchor means are provided on each side of said structure aligned parallel to the center axis of said structure, and said support track progressively engages the ones of said anchor means at the front end of said structure and releases ones of said anchor means at the rear of said structure as the structure is moved to a new work area, said released anchor means being movable to the front end of said structure to enable movement of the structure along the ground to provide a continuing elongate work area on the ground surface.

* * * * *